United States Patent [19]

Kurita

[11] Patent Number: 4,932,655

[45] Date of Patent: Jun. 12, 1990

[54] BALANCING GAME

[75] Inventor: Toshiaki Kurita, Tokyo, Japan

[73] Assignee: Tomy Kogyo Co., Inc., Tokyo, Japan

[21] Appl. No.: 302,417

[22] Filed: Jan. 27, 1989

[30] Foreign Application Priority Data

Jan. 28, 1988 [JP] Japan ..... 63-9781[U]

[51] Int. Cl.[5] ..... A63F 9/00

[52] U.S. Cl. ..... 273/1 GF

[58] Field of Search ..... 273/1 GF, 1 GC; 267/153; 248/634, 632, 633; 272/111

[56] References Cited

U.S. PATENT DOCUMENTS 3,764,134 10/1973 Reinertsen ..... 273/1 GF
4,303,240 12/1981 Ellman et al. ..... 273/1 GF
4,750,720 6/1988 Wolf et al. ..... 267/153 X

FOREIGN PATENT DOCUMENTS 1361584 5/1972 United Kingdom .

*Primary Examiner*—Paul E. Shapiro
*Attorney, Agent, or Firm*—Staas & Halsey

[57] ABSTRACT

A balancing game includes an elastic support having upper and lower horizontal support plates. A plurality of weight pieces, which are equally distributed amongst players at the start of the game, are placed on the upper support plate one-by-one in rotating turn by the players until one player exhausts his or her supply of pieces. The support tends to be more easily unbalanced and spill pieces with the increasing weight. A player whose last-played piece causes a spill must take possession of the spilled pieces and thereby decreases his or her chances of running out of pieces.

12 Claims, 2 Drawing Sheets

BALANCING GAME

BACKGROUND OF THE INVENTION

1. Field of the Invention

The present inVention relates generally to amusement devices and, more specifically, to a game device in which players sequentially pile pieces on a support made of open cell foam or other soft material and attempt to keep the pieces from sliding off.

2. Description of the Related Art

Conventionally, a game has been well known wherein players compete with each other for continuance of keeping the balanced state of a balancing member as they put a weight on the balancing member in sequence. That is, the loser is the player who breaks the balance, or causes the balancing member or weights to fall down.

A continuing problem has been that this type of game tends to be mechanically complex and thus expensive to manufacture. Also, known devices tend to have visually unrecognizable balanced states.

SUMMARY OF THE INVENTION

An object of the present invention is to provide a balancing game which is relatively simple in construction and cost effective to produce.

Another object of the invention is to provide a balancing game capable of having a visually recognizable balanced state, and a visually recognizable transition between balanced and unbalanced states.

Yet another object of the present invention is to provide a method of playing a balancing game based on the player's ability to prevent an unbalanced state from occurring.

In a preferred embodiment, a balancing game includes an elastic support having a horizontal top, a horizontal bottom, contoured sides, a front and a rear, first and second planar support plates connected respectively to the top and bottom, and a plurality of weight pieces for placement on the first support plate successively by individual players. The elastic support has a propensity to become unbalanced and undergo tilting action under the influence of the accumulated weight of the weight pieces applied to the support plate, thus causing weight pieces to spill. A player whose added piece precipitated a spill must take possession of the spilled pieces. The first player to exhaust his or her supply of weight pieces wins the game.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
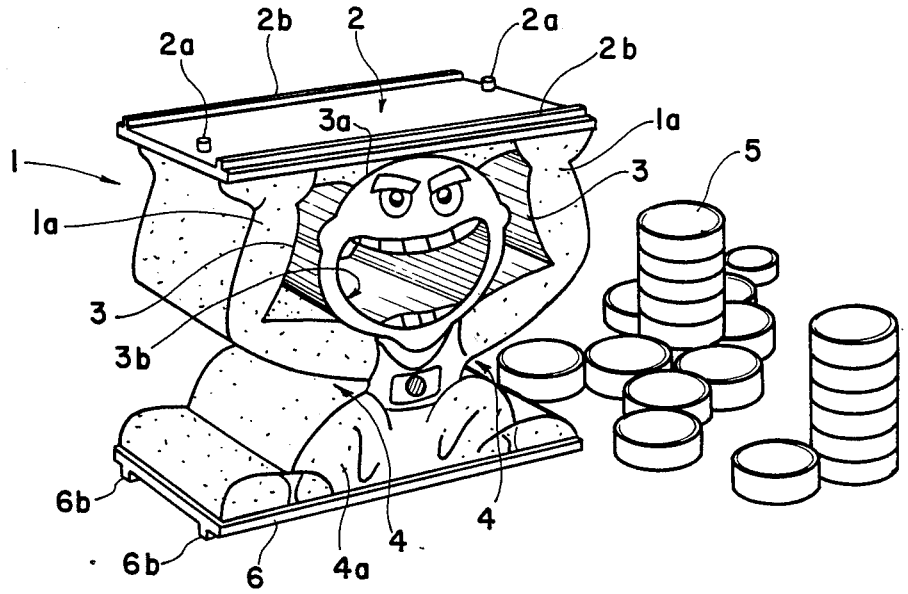
FIG. 1 is a perspective view of a first, preferred embodiment of the balancing game according to the present invention.
Figure 2:
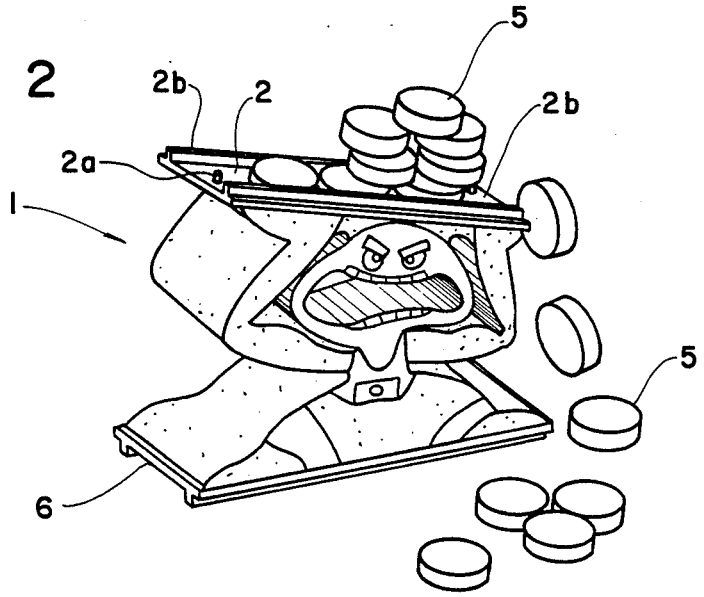
FIG. 2 is a perspective view of the balancing game of FIG. 1 illustrated in an unbalanced state.
Figure 3:
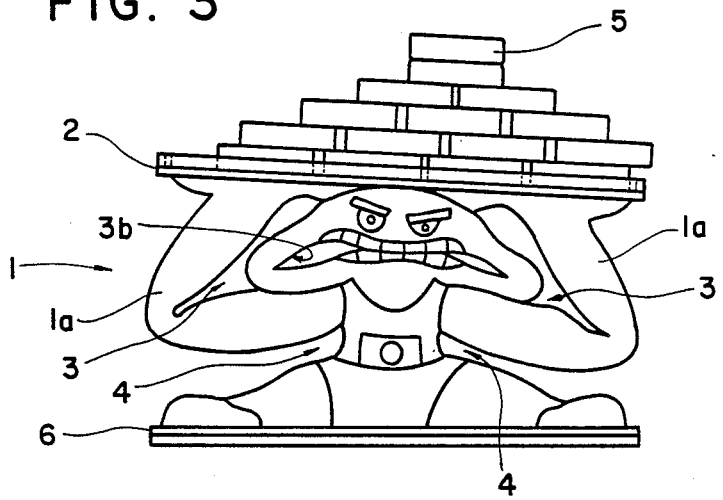
FIG. 3 is a front view of the balancing game of FIG. 1 illustrated in a balanced state.

Referring to FIGS. 1–3, a support 1 is punch cut or otherwise formed from a block of open-cell foam material which is preferably polyurethane foam resin having a constant elasticity. Other suitable materials may be used as long as the material is resilient, elastically deformable and light weight.

In the embodiment of FIGS. 1–3, the support 1 is shaped to resemble a weight lifter. Since it is cut from a sheet or block of foam material, the front and rear surfaces of the support 1 are flat, as well as the top and bottom surfaces. Arm portions 1*a* are formed on opposite sides by shaping the outer sides of the support 1 and cutting symmetrically disposed openings 3 on opposite sides of a head portion 3*a*.

A large opening 3*b* is formed in the head portion 3*a* and extends between the flat front and rear surfaces. Opening 3*b* corresponds to the mouth of the head portion. Other facial features associated with the head portion, such as eyes and teeth, may be painted on as illustrated in the drawings.

The support 1 tapers inwardly at a mid-portion thereof by virtue of symmetrically disposed cut-away portions 4. The cut-away portions 4 define lower portions of the arm portions 1*a* and upper portions of a base 4*a* which is shaped to resemble the legs of the weight lifter in a squat position.

The cut-away portions 4 and the openings 3 and 3*b* reduce the elasticity of the open cell foam material, meaning that the ability to oppose a compressive force is diminished, but not the "resiliency" of the support 1. Thus, when weight is applied from above, the foam material compresses more readily, and the original shape (that of a weight lifter) is restored when the weight is removed. Moreover, because of the radial inward taper provided by the cut-away portions 4, an upper portion of the support 1 tends to rock back and forth at the area of foam between the two cut-away portions 4. Thus, since the support is of significant vertical dimension, a relatively high, destabilizing center of gravity is created when any weight is placed on top. Weight which is not centered on the vertical axis of the support 1 will thereby tend to tilt the upper portion of the support to whichever side of the vertical axis the weight is placed.

An upper base plate 2 is connected to the flat top surface by any conventional means, such as adhesive binding. A pair of guide rails 2*b* are provided at or near front and rear longitudinal edges of the base plate 2 to keep weights from sliding forwardly or rearwardly. The upper surface of the upper base plate receives weight pieces 5, as will be described below. Projections 2*a* are provided on opposite sides of the upper base plate 2, eccentric to the longitudinal center line of the upper base plate 2 to prevent pieces 5 from improperly sliding down.

A lower base plate 6 is similar to the upper base plate 2 in all respects, and includes longitudinal guide rails 6*b*. Projections (not shown) on lower guide rail 6, and the guide rails 6*b* perform the same functions as rails 2*b* and projections 2*a* of upper base plate 2 when the support 1 is inverted.

Weight pieces 5 are made of synthetic resin in the shape of discs. This plastic material is preferably of higher molecular weight. When sufficient numbers of the weight pieces 5 are placed on the upper support plate 2, the support 1 will be placed in compression. If the compressive weight is off center to cause sufficient tilting, the weight pieces 5 will spill as shown in FIG. 2.

The balancing game is intended to be played by two or more players. First, the weight pieces are distributed evenly amongst the players. After determining the order of the players, each player successively places a weight piece 5 one by one on the base plate 2. After repeated turns, the accumulated weight of the weight pieces 5 gradually applies a compressive force on the supporter 1. If the weight or gravity force acts through the center of gravity of the support 1, the support will evenly compress until the mouth opening 3 of the weight lifter closes and the arm portions 1*a* bend as shown in FIG. 3. Thus, the teeth of the weight lifter appear to be gritting under the strain of great weight.

As the weight is added, the support 1 becomes more unbalanced, as the open cell foam material tends to elastically push upwardly against the weight pieces 5. Eventually, the weight pieces slide off the support plate 2. The fallen pieces are collected by the player whose last placed piece caused the tilting which resulted in piece-spilling. The player who is first to run out of pieces is the winner. In playing the game, each player determines where to place his or her weight pieces.

Figure 4:
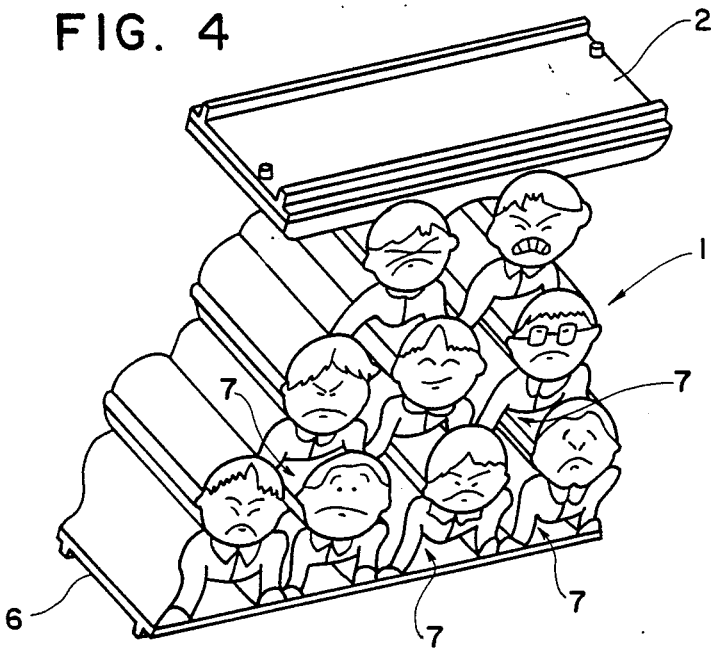
FIG. 4 is a perspective view of a second, preferred embodiment of the balancing game according to the present invention.

FIG. 4 is a second embodiment of the present invention, and differs only in the shape of the support. In FIG. 4, the support 1 is configured to resemble a group of children in an acrobatic or tumbling formation. A plurality of opening 7 are provided between children, and the rocking action of the support 1 will occur predominantly at the thinnest part thereof.

The many features and advantages of the present invention are apparent from the detailed specification, and thus, it is intended by the appended claims to cover all such features and advantages of the balancing game apparatus which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed:

1. A balancing game comprising:

an elastic support having a horizontal top, a horizontal bottom, contoured sides, a front and a rear;

first and second substantially planar support plates connected respectively to the horizontal top and bottom; and a plurality of weight pieces for placement on the first support plate successively by individual players, said elastic support being compressible by the weight of the weight pieces and having a propensity to become unbalanced and undergo tilting action when compressed by the weight of the weight pieces, said tiling action causing weight pieces to spill;

wherein the support is made of open-cell foam material.

2. A balancing game as claimed in claim 1, wherein a plurality of openings are formed laterally through the support to render the same more easily compressible and unbalanced.

3. A balancing game as claimed in claim 1, wherein the elastic support is invertible so that the weight pieces are placed on the second support plate.

4. A balancing game as claimed in claim 1, wherein the open-cell foam is a polymeric foam.

5. A balancing game as claimed in claim 4, wherein the polymeric foam is a polyurethane foam resin.

6. A balancing game as claimed in claim 1, wherein the support is contoured to include a head portion, leg portions, and two arm portions, wherein openings are provided in the support on opposite sides of the head portions to form the two arm portions.

7. A balancing game as claimed in claim 6, wherein the head portion is provided with an opening which forms a mouth which closes when sufficient weight of the weight pieces is applied to the first support plate.

8. A balancing game as claimed in claim 1, wherein each of the first and second support plates has a pair of longitudinal guide rails along longitudinal edges thereof, and a pair of projections at lateral edges thereof to prevent spilling.

9. A balancing game as claimed in claim 1, wherein the support is contoured to form a plurality of stacked figures resembling children.

10. A balancing game comprising:

an elastic support having a horizontal top, a horizontal bottom, contoured sides, a front and a rear;

first and second substantially planar support plates connected respectively to the horizontal top and bottom; and a plurality of weight pieces for placement on the first support plate successively by individual players, said elastic support being compressible by the weight of the weight pieces and having a propensity to become unbalanced and undergo tilting action when compressed by the weight of the weight pieces, said tiling action causing weight pieces to spill;

wherein the support is contoured to include a head portion, leg portions, and two arm portions, wherein openings are provided in the support on opposite sides of the head portions to form the two arm portions.

11. A balancing game comprising:

an elastic support having a horizontal top, a horizontal bottom, contoured sides, a front and a rear;

first and second substantially planar support plates connected respectively to the horizontal top and bottom; and p1 a plurality of weight pieces for placement on the first support plate successively by individual players, said elastic support being compressible by the weight of the weight pieces and having a propensity to become unbalanced and undergo tilting action when compressed by the weight of the weight pieces, said tiling action causing weight pieces to spill;

wherein each of the first and second support plates has a pair of longitudinal guide rails along longitudinal edges thereof, and a pair of projections at lateral edges thereof to prevent spilling.

12. A balancing game comprising:

an elastic support having a horizontal top, a horizontal bottom, contoured sides, a front and a rear;

first and second substantially planar support plates connected respectively to the horizontal top and bottom; and a plurality of weight pieces for placement on the first support plate successively by individual players, said elastic support being compressible by the weight of the weight pieces and having a propensity to become unbalanced and undergo tilting action when compressed by the weight of the weight pieces, said tilting action causing weight pieces to spill;

wherein the support is contoured to form a plurality of stacked figures resembling children.

* * * * *